United States Patent [19]

Pritchard et al.

[11] Patent Number: 4,886,964

[45] Date of Patent: Dec. 12, 1989

[54] MATTER WAVE OPTICAL SYSTEMS IN WHICH AN ATOMIC BEAM INTERSECTS A DIFFRACTION GRATING AT A GRAZING INCIDENCE

[75] Inventors: David E. Pritchard, Cambridge, Mass.; David W. Keith, Ottawa, Ontario, Canada

[73] Assignee: Massachusetts Institute of Technology, Cambridge, Mass.

[21] Appl. No.: 245,687

[22] Filed: Sep. 16, 1988

[51] Int. Cl.[4] ..... H01J 39/34

[52] U.S. Cl. ..... 250/251

[58] Field of Search ..... 250/251

[56] References Cited

U.S. PATENT DOCUMENTS

| | | | |
|---|---|---|---|
| 3,532,879 | 10/1970 | Braunstein et al. | 250/251 |
| 3,558,877 | 1/1971 | Pressman | 250/251 |
| 3,761,721 | 9/1973 | Altshuler et al. | 250/251 |
| 3,778,612 | 12/1973 | Ashkin | 250/251 |
| 4,025,787 | 5/1977 | Janner et al. | 250/251 |
| 4,035,638 | 7/1977 | Szöke | 250/251 |
| 4,386,274 | 5/1983 | Altshuler | 250/251 |
| 4,775 ,789 | 10/1988 | Albridge, Jr. et al. | 250/251 |

OTHER PUBLICATIONS

"Interference of Atoms in Separated Optical Fields", Chebotayev et al., J. Opt. Soc. Am. B, vol. 2, No. 11/Nov. 1985.

"Diffraction-Grating Neutron Interferometer", A. I. Ioffe et al., JETP Lett., vol. 33, No. 7, Apr. 1981.

Proposal to National Science Foundation by David E. Pritchard, Dec. 23, 1985.

*Primary Examiner*—Carolyn E. Fields
*Assistant Examiner*—John A. Miller
*Attorney, Agent, or Firm*—Fish & Richardson

[57] ABSTRACT

The optical system includes a matter diffraction grating and an atomic beam intersecting the grating at a grazing angle of incidence. The grazing incidence angle should be less than $10^{-2}$ radians. At such shallow angles of incidence, neutral atomic beams are diffracted by conventional diffraction gratings. A suitable grating has a local flatness of 10 Angstroms and has 2400 lines per millimeter. Preferred embodiments include interferometers, beam splitters and combiners, and velocity selectors.

12 Claims, 1 Drawing Sheet

MATTER WAVE OPTICAL SYSTEMS IN WHICH AN ATOMIC BEAM INTERSECTS A DIFFRACTION GRATING AT A GRAZING INCIDENCE

The Government has rights in this invention pursuant to Grant Number PHY8605893 awarded by the National Science Foundation.

BACKGROUND OF THE INVENTION

This invention relates to matter wave optical systems.

It is known that matter such as neutral atoms exhibits wave characteristics known as matter or deBroglie waves. It is also known that resonant standing light waves form an effective diffraction grating for neutral atoms. Such resonant standing waves have been proposed to split an atomic beam into two mutually coherent beams which can be used for interferometry. See, "Interference of Atoms in Separated Optical Fields" by V. P. Chebotayev et al., Vol. 2, No. 11, J. Opt. Soc. Am., November 1985. The applicants herein have demonstrated the splitting of an atomic beam into two mutually coherent beams by the use of resonant standing waves. The angular deflections of neutral atom beams generated by light gratings are small requiring relatively long interferometer paths to physically separate the beams.

SUMMARY OF THE INVENTION

The matter wave optical system according to the invention includes a conventional diffraction grating and an atomic beam intersecting the grating at a grazing incidence. The grazing incidence angle should be sufficiently small that conventional diffraction gratings may be utilized. A suitable grazing angle is less than $10^{-1}$ radians and preferably less than $10^{-2}$ radians. At low angles of incidence, $\theta$, the required grating flatness is relaxed to $\lambda_{db}/\theta$. A suitable grating has a local flatness of 10 Angstroms and has 2400 lines per millimeter. Preferred embodiments of the present invention include interferometers, beam splitters and combiners, and velocity selectors. One interferometer embodiment of the invention includes a flat polished surface or crystal face for coherent reflection of matter waves.

The matter wave optical system of the invention utilizing conventional matter gratings produces much greater angular deflections than light gratings. Furthermore, beam intensities in devices using these gratings may be many times larger than that produced by light gratings owing to greater usable width of the atomic beam.

DESCRIPTION OF THE PREFERRED EMBODIMENTS

Matter of deBroglie waves have very short wavelengths. For example, sodium atoms moving at a velocity of $10^3$ meters per second have a deBroglie wavelength of 0.02 nanometers. This distance is far smaller than the ruling size on conventional gratings. It has heretofore been thought impossible, therefore, to diffract deBroglie waves using conventional diffraction gratings. The applicants herein have recognized that conventional matter diffraction gratings can diffract neutral atomic beams which intersect the grating at grazing angles of incidence. Furthermore, the grazing angle of incidence relaxes the flatness and mechanical stability required for such a grating to achievable levels.

Figure 1:
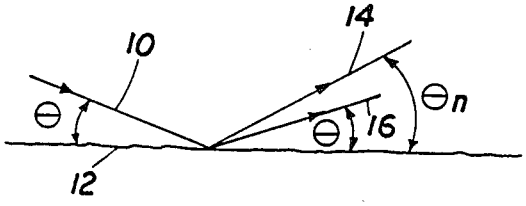
FIG. 1 is a cross-sectional view of the matter wave optical system according to the invention.

The optical system of the invention is shown in FIG. 1. A beam 10 of neutral atoms impinges upon a diffraction grating 12 at an angle of incidence $\theta$. The angle $\theta$ is preferably less than $10^{-2}$ radians. The angles in the figures have, of course, been exaggerated for clarity. After encountering the diffraction grating 12, the beam 10 is split into coherent beams 14 and 16. The beam 16 is the specular reflection from the grating 12 and emerges at the angle $\theta$. The beam 14 is a diffracted beam and emerges at an angle $\theta_n$ where n is the diffraction order. For grazing incidence at an angle $\theta$, the usual grating condition simplifies to $\theta_n^2-\theta^2=2n(\lambda_{db}/d)$, where $\lambda_{db}$ is the deBroglie wavelength, n is the diffraction order and d is the grating spacing. For example, if the beam 10 consists of sodium atoms moving at a velocity of $10^3$ meters per second $\lambda_{db}$ is 0.02 nanometers. If the grazing angle of incidence $\theta$ is $10^{-3}$ radians, $\theta_1$, the first diffraction order, will be $10^{-2}$ radians when the diffraction grating 12 has 2400 lines per millimeter. Under these conditions an acceptable level of local flatness for the diffraction grating 12 is 10 Angstroms. Gratings with this level of flatness and having 2400 lines per millimeter are commercially available. It should be noted that any neutral atom beam may be used. The example above for sodium atoms is entirely exemplary. Experiments will also be conducted using helium atoms.

It will be readily appreciated that the embodiment of FIG. 1 serves as a beam splitter creating coherent beams 14 and 16 from the single incident beam 10. Furthermore, it should be appreciated that since $\theta_n$ is a function of deBroglie wavelength which itself is a function of velocity of the atoms in the beam 10, the embodiment of FIG. 1 serves as a velocity selector. That is, atoms in the diffracted beam 14, for a given value of $\theta_1$, for example, will all have the same velocity. Atoms in the beam 10 having a different velocity will emerge at a different angle. It will also be recognized by those skilled in the art that the embodiment of FIG. 1 can also serve as a beam combiner. Thus, if the beams 14 and 16 are considered incident neutral atoms beams, they will be combined coherently into an output beam 10, and another beam travelling to the left at an angle $\theta_1$ to the grating.

Figure 2:
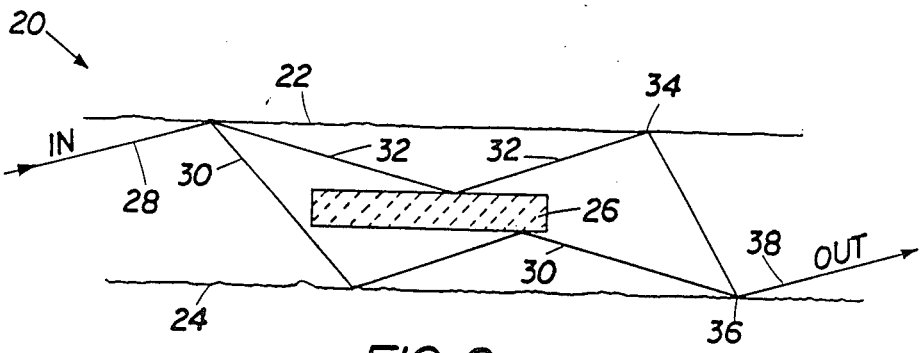
FIG. 2 is a cross-sectional view of an interferometer using the principles of the invention.

A particularly important application of the present invention is a matter-wave interferometer. A matter wave interferometer utilizing the principles of the invention is shown in FIG. 2. An interferometer 20 includes a pair of diffraction gratings 22 and 24. A mirror 26 is disposed midway between the gratings 22 and 24. The mirror 26 has flat surfaces which reflect matter waves coherently, and which may be produced by either cleaving a crystal or polishing. The mirror 26 and the gratings 22 and 24 are aligned to be mutually parallel using conventional optical interferometric techniques. Subsequent fine adjustment will be necessary (to achieve maximum phase contrast) using the atomic beams.

An input beam of neutral atoms 28 intersects the grating 22 at a grazing angle of incidence as discussed above and is split into two coherent beams 30 and 32. The diffracted beam 30 intersects the grating 24. The beam 32 is specularly reflected from the grating 22 and is subsequently specularly reflected from the mirror 26 onto the grating 22 at the point 34. The beam 32 is diffracted from the grating 22 so that it intersects the grating 24 at the point 36. The beam 30 is similarly diffracted and reflected and it too arrives at the point 36 where it is combined with the beam 32 to produce an output beam 38. It should be noted that the configuration in FIG. 2 offers wavelength-independent performance. That is, atoms in the input beam 28 having differing velocities, and hence different wavelengths, will nonetheless be combined in phase in the output beam 38, although the output beam will be slightly displaced laterally. The wavelength-independent performance results from the equal length arms in the interferometer 20 which generates a so-called "white fringe". Furthermore, the interferometer 20 accepts atoms which have finite lateral displacement from the center of the input beam. It should be noted that the grating 22 may be made of separate sections. However, having the grating 22 be a single grating makes alignment easier. The same applies, of course, to the grating 24.

Figure 3:
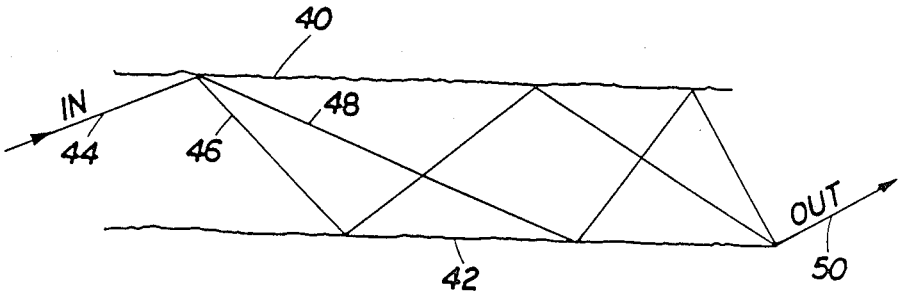
FIG. 3 is another interferometer embodiment utilizing the principles of the invention.

Yet another interferometer embodiment is shown in FIG. 3. This embodiment eliminates the need for the mirror 26 in the embodiment in FIG. 2. The embodiment of FIG. 3 requires parallel diffusion gratings 40 and 42. An input beam 44 of neutral atoms is split into beams 46 and 48 upon interaction with the diffraction grating 40 at grazing angles. The beams interact with the grating as shown and are subsequently recombined to form an output beam 50.

As will be appreciated by those skilled in the art, if one of the spatially separated atomic beams in the interferometers of FIGS. 2 and 3 is subjected to an interaction, this interaction will cause a phase shift in the atomic wave function which quantum-mechanically describes that atomic beam. Depending on the phase shift, the two spatially distinct atomic beams will interfere constructively or destructively when they are recombined. The interference creates oscillations in the output beam intensity in response to differential phase shifts between the two physically separate atomic beams. Hence, any interaction which shifts the energy of atoms in either arm of the interferometer will be observable by a detector (not shown) responsive to the oscillations in output beam intensity. Sources of interaction detectable by the interferometers disclosed herein are interactions with electric and magnetic fields, the Casimir shift due to interaction with nearby conducting surfaces, collisions with other atoms, or gravitational interactions. In addition, the interferometer can be used to measure the Sagnac effect which is a phase shift caused by rotations of the interferometer. The sensitivity of these neutral atom interferometers is sufficient to perform precise atomic polarizability measurements for both DC and laser light fields, to observe the Casimir shift near conducting surfaces, and to measure the real part of the forward scattering amplitude from gas targets. Because the interferometers are sensitive to the Sagnac effect, they may be used as a "gyro" for measuring rotation for navigational purposes.

It is recognized that modifications and variations of the present invention will occur to those skilled in the art and it is intended that all such modifications and variations be included within the scope of the appended claims.

What is claimed is:

1. Matter wave optical system comprising:
a matter diffraction grating; and
an atomic beam intersecting the grating at a grazing incidence.

2. The system of claim 1 wherein the grazing incidence is less than $10^{-1}$ radian.

3. The optical system of claim 1 wherein the grating has approximately 2400 lines per millimeter.

4. The optical system of claim 1 wherein the grating has local flatness of approximately 10 Angstroms.

5. The system of claim 1 where the atomic beam comprises sodium atoms.

6. The optical system of claim 1 wherein the atomic beam comprises helium atoms.

7. A matter wave optical system comprising:
a matter diffraction grating; and
an atomic beam intersecting the grating at a grazing incidence, said grating comprising means for splitting the atomic beam.

8. A velocity selector system comprising:
a matter diffraction grating; and
an atomic beam intersecting the grating at a grazing incidence such that all atoms diffracted from the interaction with the grating at a given angle have the same velocity.

9. Matter wave interferometer comprising:
a pair of spaced apart, parallel matter diffraction gratings arranged for receiving an input beam of neutral atoms at a grazing angle of incidence, for splitting the input beam into separate coherent beams and for combining the beams to produce a coherent output beam.

10. The interferometer of claim 9 further including a mirror disposed between the two diffraction gratings.

11. Method for splitting a beam of neutral atoms into coherent beams comprising:
interacting the beam with a matter diffraction grating at a grazing angle of incidence.

12. Matter wave optical system comprising:
a flat polished surface; and
an atomic beam intersecting the surface at a grazing incidence wherein the atomic beam is reflected coherently.

* * * * *